US005289926A

United States Patent [19]

Lewis et al.

[11] Patent Number: 5,289,926

[45] Date of Patent: Mar. 1, 1994

[54] DISPLAY RACK

[76] Inventors: Timothy D. Lewis, 437 Betsy Bell Rd.; Paul A. Braginetz, 214 Oak Ridge Cir., both of Staunton, Va. 24401

[21] Appl. No.: 944,950

[22] Filed: Sep. 15, 1992

[51] Int. Cl.[5] ..... A47F 7/00

[52] U.S. Cl. ..... 211/45; 211/55; 40/124

[58] Field of Search ..... 211/50, 45, 55, 73; 248/174; 40/124, 124.2, 124.4; 273/150, 148 A

[56] References Cited

U.S. PATENT DOCUMENTS

| | | | |
|---|---|---|---|
| 1,881,986 | 10/1932 | Webster . | |
| 1,927,171 | 9/1933 | Horwath . | |
| 2,019,371 | 10/1935 | Tompkins | 40/124 |
| 2,141,216 | 12/1938 | Mancuso . | |
| 2,324,232 | 7/1943 | Pantalone . | |
| 2,785,901 | 3/1957 | McLemore | 273/150 |
| 4,164,287 | 8/1979 | Muller . | |
| 4,651,872 | 3/1987 | Joyce | 40/124.2 X |

FOREIGN PATENT DOCUMENTS

| | | | |
|---|---|---|---|
| 604789 | 9/1978 | Switzerland | 273/150 |

*Primary Examiner*—Robert W. Gibson, Jr.
*Attorney, Agent, or Firm*—Brady, O'Boyle & Gates

[57] ABSTRACT

A display rack wherein a one-piece die cut blank is constructed and arranged to be folded and interconnected to form a plurality of stepped card receiving slots or pockets forming a terraced display rack for items, such as baseball and football cards. The rack can be substantially trapezoidal in configuration so that a plurality of such racks can be placed in side-by-side relationship to form an enclosure resembling a stadium. A base board can be employed for holding the racks in side-by-side relationship, and indicia representing a playing field is placed on the base board within the enclosure.

12 Claims, 8 Drawing Sheets

DISPLAY RACK

BACKGROUND OF THE INVENTION

U.S. Pat. No. 2,324,232 discloses a one-piece die cut cardboard blank constructed and arranged to form a terraced display rack. While this display rack is satisfactory for its intended purpose, the blank is not folded and interconnected to form card-receiving slots.

SUMMARY OF THE INVENTION

After considerable research and experimentation, the display rack of the present invention has been devised which comprises, a one-piece die cut cardboard blank constructed and arranged to be folded and interconnected to form a plurality of stepped items-receiving slots forming a display rack for trading cards, such as baseball and football cards.

In one embodiment, the die cut blank is substantially rectangular, whereby a straight sided rack is formed when the blank is folded and interconnected, and, in another embodiment, the die cut blank is substantially trapezoidal, whereby a convergent sided rack is formed, when the blank is folded and interconnected. In the second embodiment, a plurality of display racks can be positioned in side-by-side relationship to form an enclosure resembling a stadium. A base board having upwardly extending tabs is provided for holding the display racks in side-by-side relationship.

DESCRIPTION OF THE PREFERRED EMBODIMENTS

Figure 1:
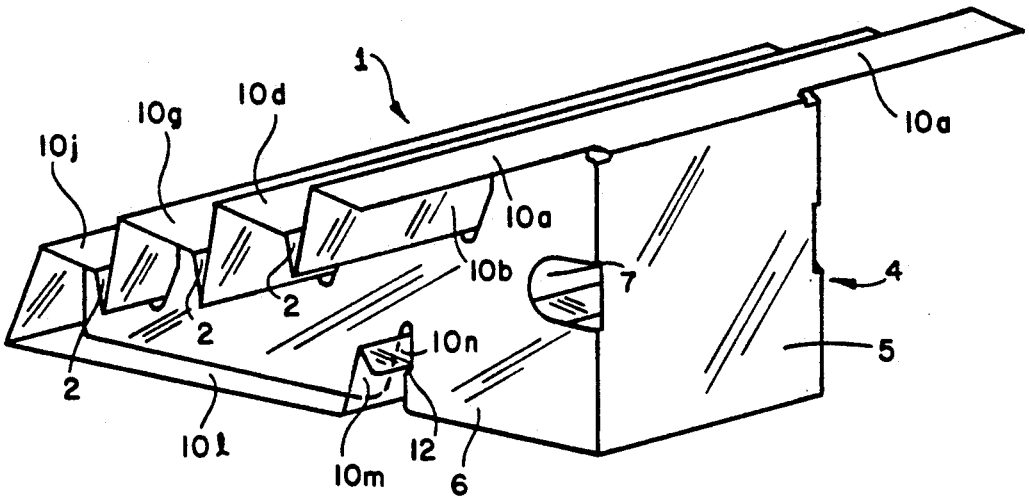
FIG. 1 is a perspective view of one embodiment of the invention showing one side and the rear of a rack.
Figure 2:
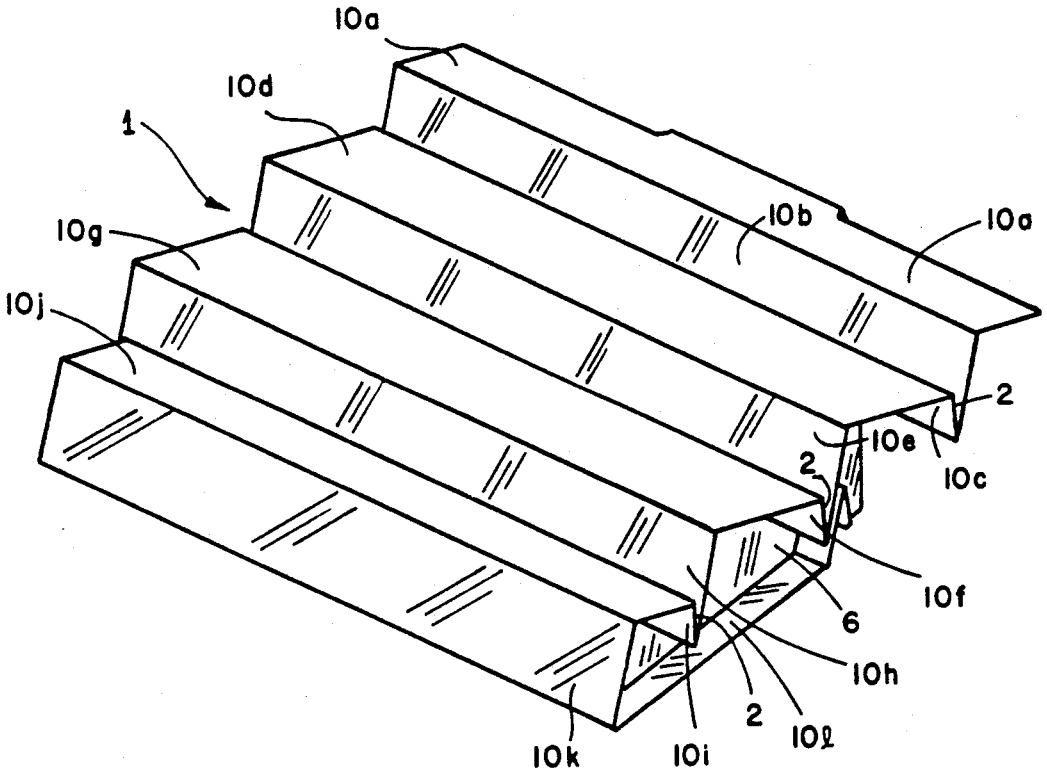
FIG. 2 is a perspective view showing the front of the rack a shown in FIG. 1.
Figure 5:
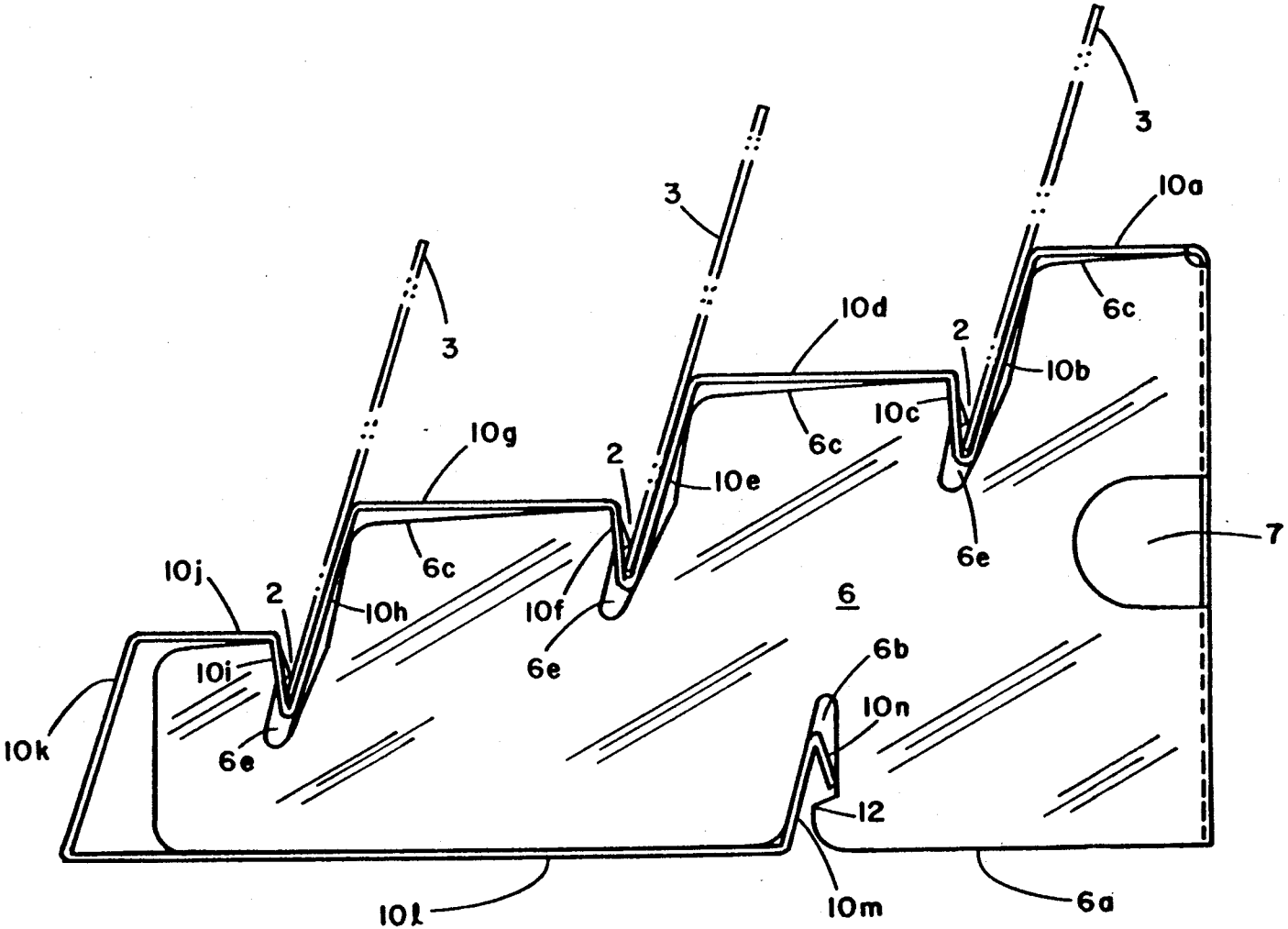
FIG. 5 is a side elevational view of the terraced rack having cards mounted in the stepped slots.
Figure 6:
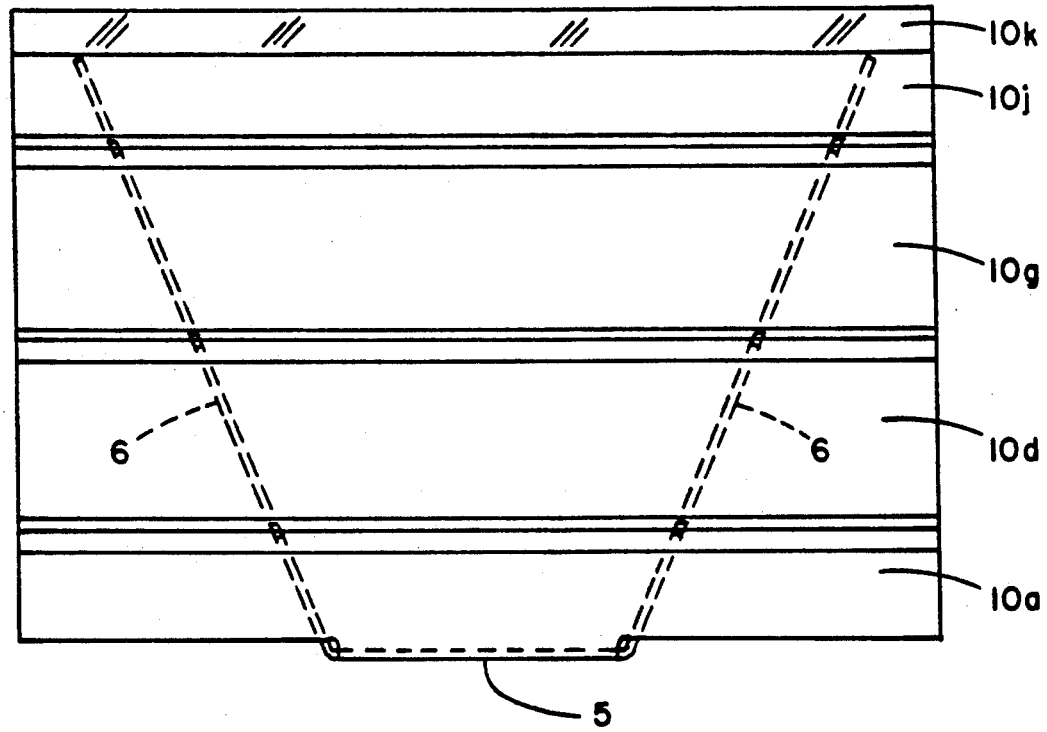
FIG. 6 is a top plan elevational view of the terraced rack shown in FIG. 1.
Figure 7:
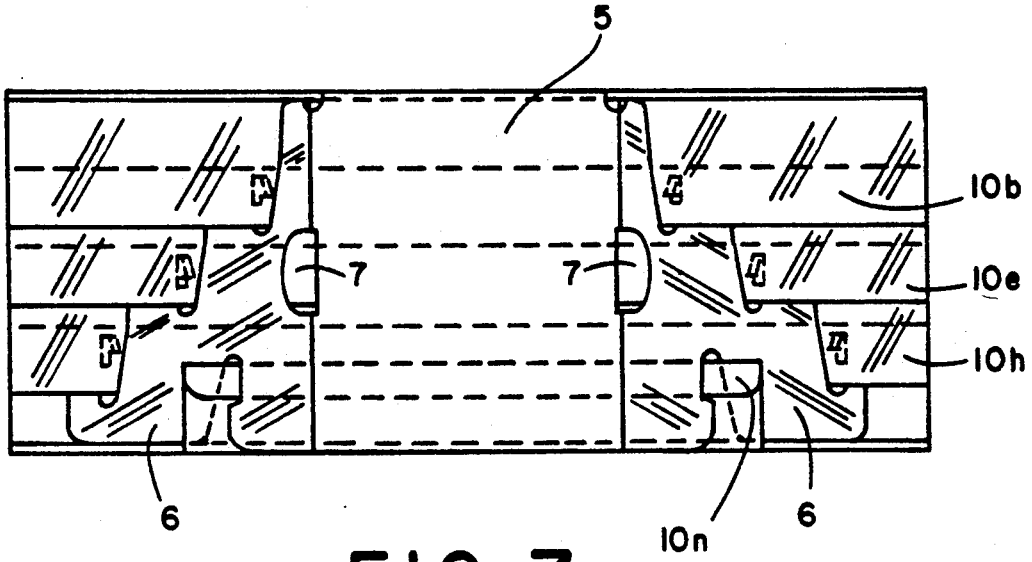
FIG. 7 is a rear elevational view of the terraced rack shown in FIG. 1.
Figure 8:
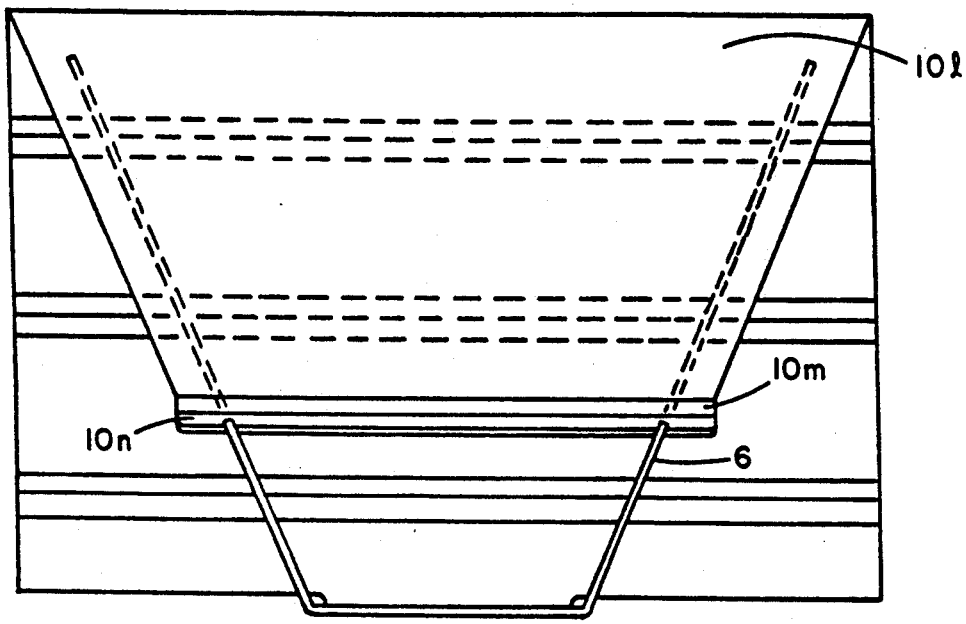
FIG. 8 is a bottom plan view of the rack shown in FIG. 1.

Referring to the drawings and more particularly to FIGS. 1 and 2, the terraced display rack 1 of the present invention comprises a one-piece die cut cardboard or plastic blank folded and interconnected to form a plurality of stepped slots 2 for receiving trading cards 3, such as football or baseball cards, as shown in FIG. 5. The rack is held in the erected position by a support structure 4, including a back wall 5, and integral forwardly extending divergent side walls 6. Finger openings 7 are formed in the side walls to facilitate handling the rack 1.

Figure 3:
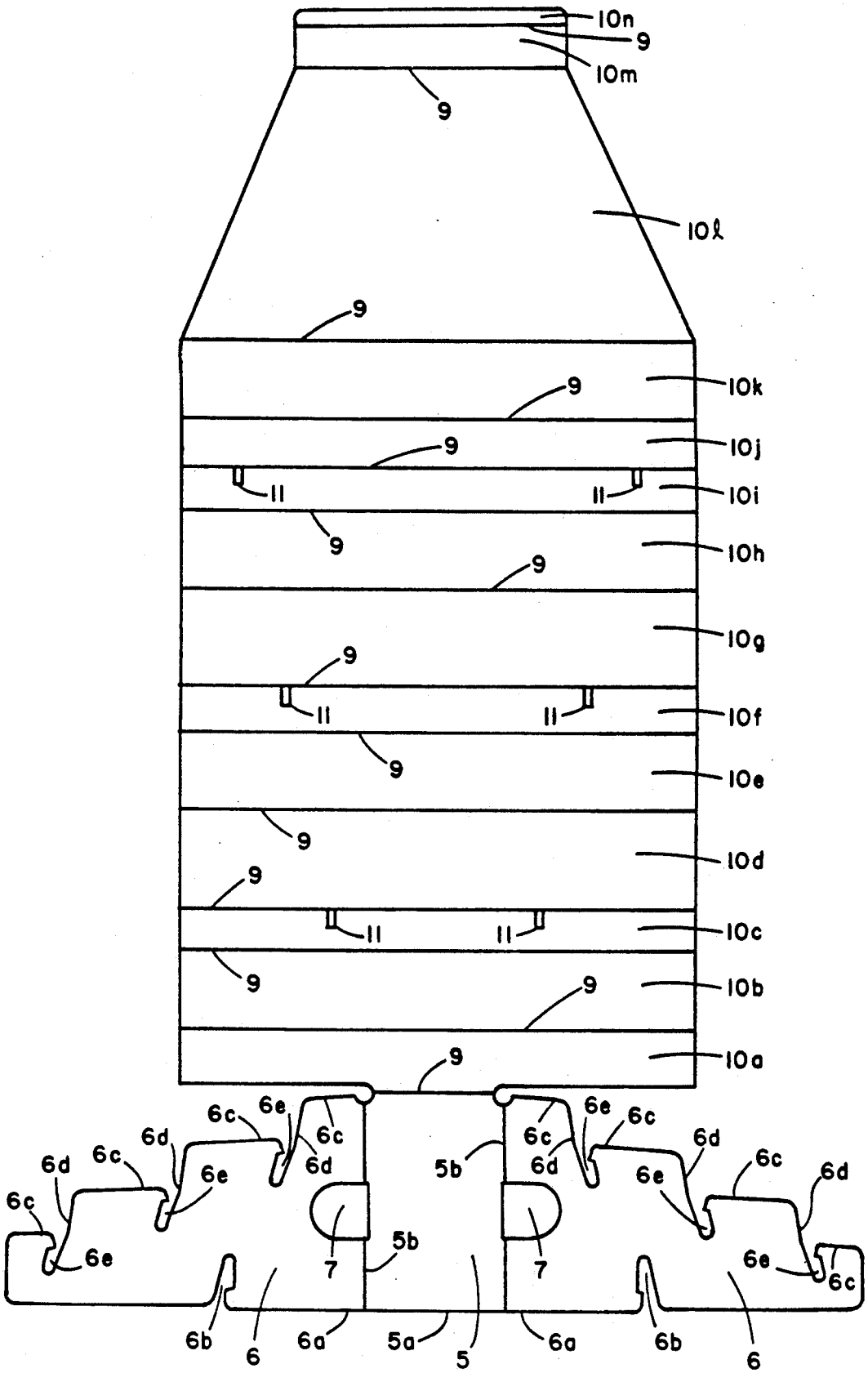
FIG. 3 is a top plan view of the die cut blank before being folded and interconnected to form the display rack of FIG. 1.

The one-piece die cut blank from which the rack shown in FIGS. 1 and 2 is formed is illustrated in FIG. 3, wherein it will be seen that the back wall 5 has integral side walls 6 extending laterally outwardly therefrom and hingedly connected thereto along score lines **5*b*. The bottom edges 5*a* and 6*a* of the back and side walls are coextensive and engage the surface upon which the rack is supported. Locking slots 6*b* are provided at the bottom edge portion of the side walls 6. The opposite or upper edge of the side walls 6 are provided with inclined spaced step portions 6*c* having inclined riser portions 6*d*, the space between adjacent steps 6*c* forming locking slots 6*e***.

The remainder of the one-piece die cut blank as shown in FIG. 3 comprises a plurality of variably spaced, parallel, score lines 9, delineating a plurality of panel portions **10*a*, 10*b*, 10*c*, 10*d*, 10*e*, 10*f*, 10*g*, 10*h*, 10*i*, 10*i*, 10*k*, 10*L*, 10*m* and 10*n* of various widths, adjacent panels being hingedly connected along the score lines 9**.

Figure 4:
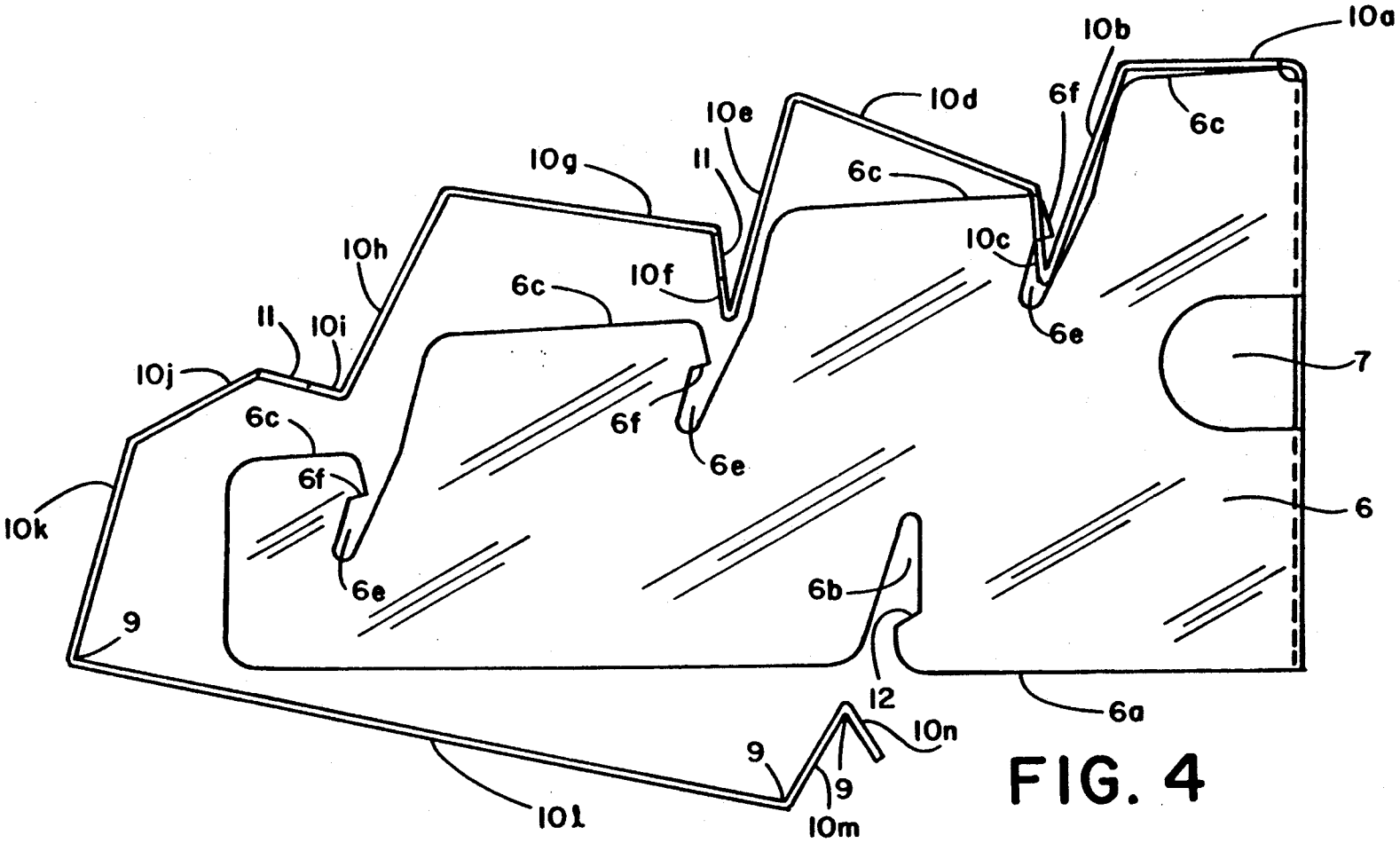
FIG. 4 is an enlarged, side elevational view illustrating the folding and interconnecting of the portions of the blank to form the rack of FIG. 1.

As will be seen in FIGS. 1 and 4, the rack is erected by turning the side walls 6 inwardly and the blank is folded so that the panels **10*a*, 10*d*, 10*i* and engage the step portions 6*c* and the panel 10*L* is folded underneath the side walls 6 and engage the lower edges thereof. The panels 10*b*, 10*c*; 10*e*, 10*f*; and 10*h*, 10*i* are inserted into the locking slots 6*e* and are held therein by tabs 6*f* provided on the leading edge of each step 6*c* and insertable through corresponding apertures 11 formed in the panels 10*c*, 10*f* and 10*i*. The panels 10*m* and 10*n* are similarly inserted into locking slot 6*b* on the bottom edge of the side walls 6 and held therein by the free end of the panel 10*n* engaging an abutment 12 provided on one wall of the locking slot 6*b***.

When erected, as shown in FIG. 5, the panels **10*b*, 10*c*; 10*e*, 10*f*; 10*h*, 10*i* provide the stepped slots 2 for receiving the cards 3** to be displayed.

Figure 9:
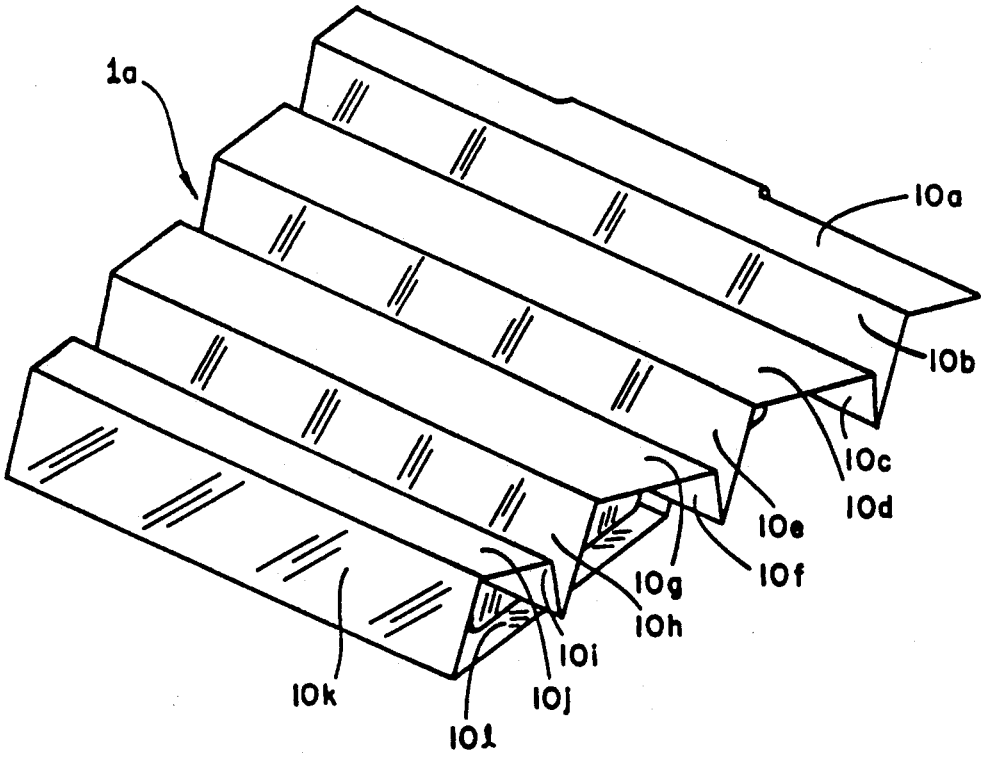
FIG. 9 is a perspective view of another embodiment of the display rack of the present invention.
Figure 10:
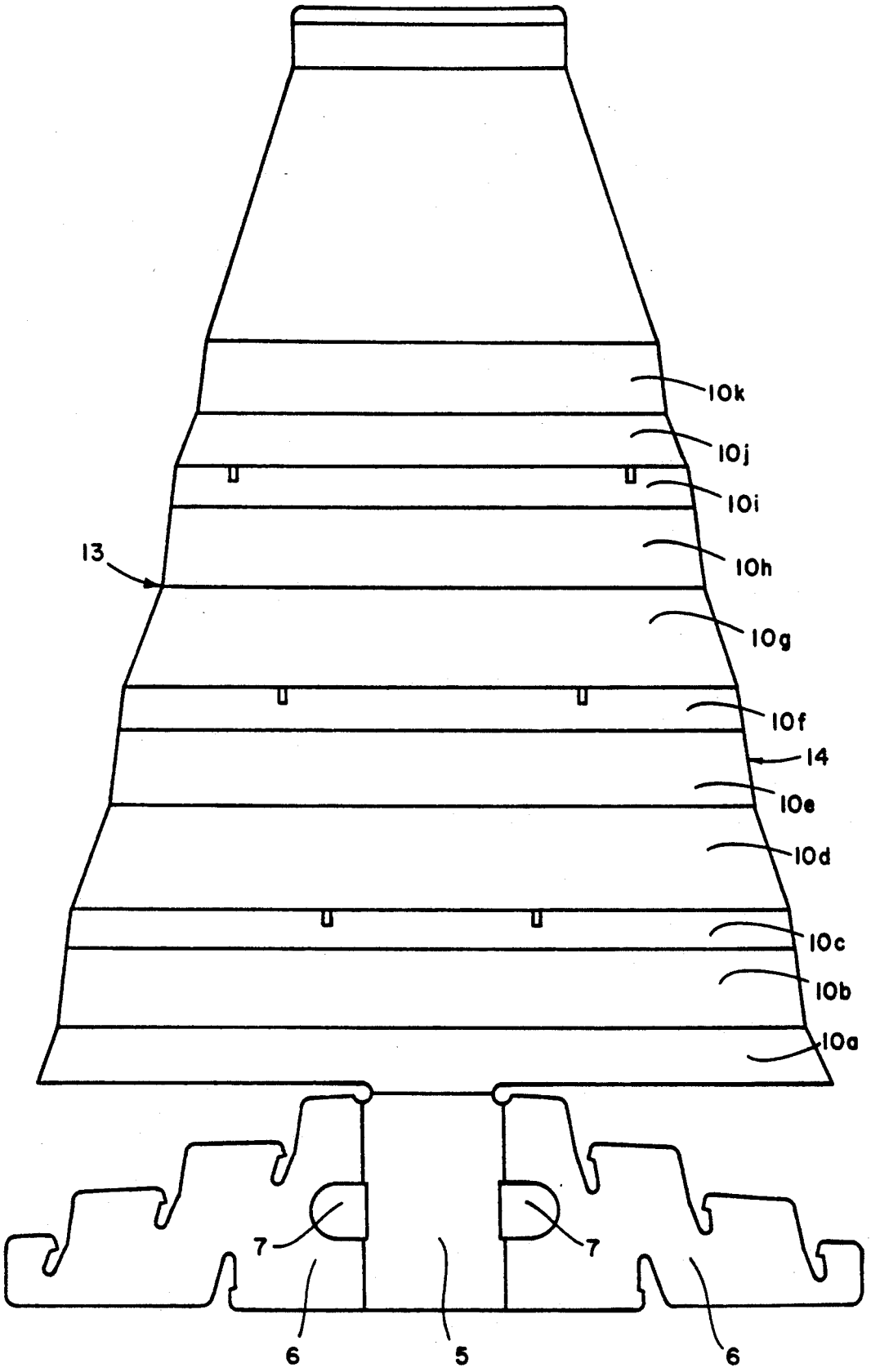
FIG. 10 is a top plan view of the die cut blank before being folded and interconnected to form the display rack of FIG. 9.

FIGS. 9 and 10 illustrate another embodiment of the card display rack 1 wherein the one-piece blank is cut so that the lateral edges 13 and 14 of the panels **10*a* . . . 10*k* are progressively inwardly extending to provide panels of different length whereby the substantially trapezoidal-shaped terrace rack la is formed when the blank is folded and interconnected as described hereinabove in connection with the embodiment of FIGS. 1, 2 and 3**.

Figure 11:
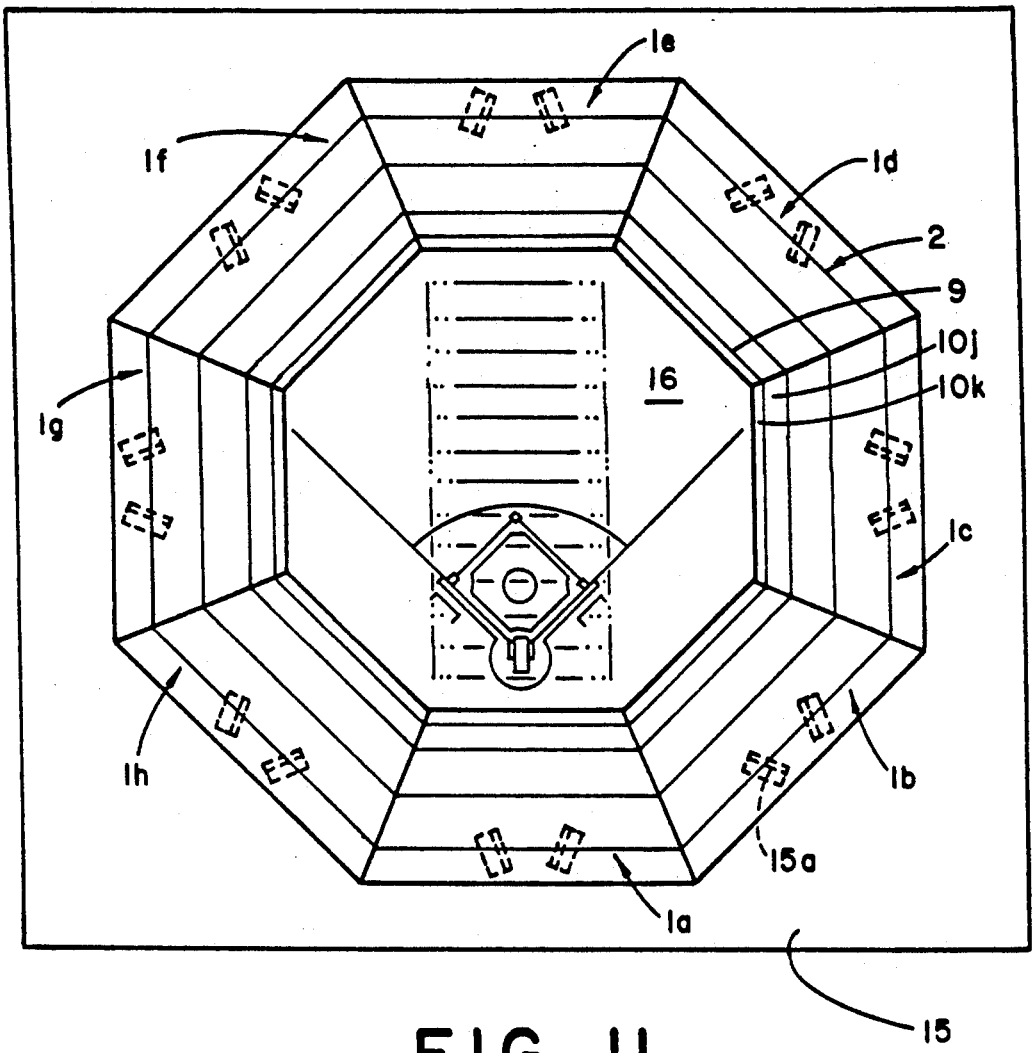
FIG. 11 is a top plan view of a plurality of the display racks shown in FIG. 9 placed in side-by-side relationship to form an enclosure resembling a stadium.
Figure 12:
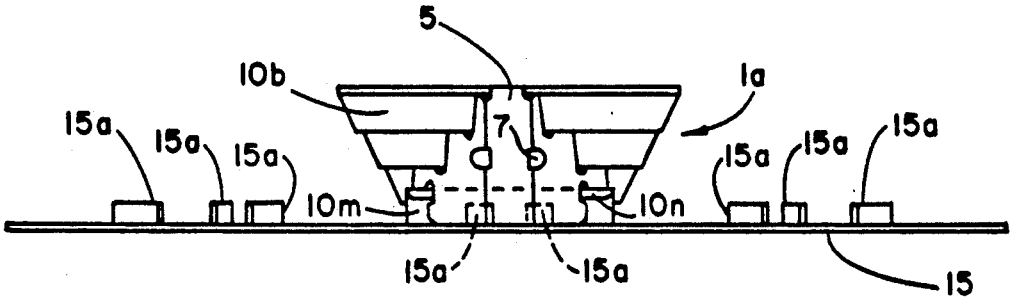
FIG. 12 is a rear elevational view of one of the display racks of FIG. 11 mounted on a base board employed to hold the display racks of FIG. 11 in side-by-side relationship.

By the construction of the trapezoidal-shaped rack **1*a*, an individual rack can be provided for displaying the cards as described hereinabove, with regard to the embodiment shown in FIGS. 1 to 8, or a plurality of similarly configured racks 1*b*, 1*c*, 1*d*, 1*e*, 1*f*, 1*g* and 1*h* can be arranged in side-by-side relationship to form the octagonal structure shown in FIG. 11** resembling a stadium.

To hold the racks **1*a* . . . 1*h* in side-by-side relationship, a base board 15 is provided having upwardly struck tabs 15*a* adapted to engage the inwardly facing surfaces of the beck wall 5 and side walls 6 of the rack, to thereby prevent the racks from shifting laterally on the board. Indicia 16 representing a playing field is pasted or printed on the upper surface of the base board 15**.

From the above description, it will be readily appreciated by those skilled in the art that the one-piece die cut blank of the present invention can be easily folded and interconnected to provide a rack having terraced card receiving slots or pockets 2 so that all of the cards 3 are readily viewable while mounted on the rack, and the configuration of the plurality of racks to form a stadium having a simulated playing field enhances the enjoyment of viewing the cards in the environment of the particular game card, whether baseball or football.

It is to be understood that the forms of the invention herewith shown and described are to be taken as preferred examples of the same, and that various changes in the shape, size and arrangement of parts may be resorted to, without departing from the spirit of the invention or scope of the subjoined claims.

We claim:

1. A display rack comprising a one-piece die cut blank having a plurality of folded and interconnected panels forming a plurality of stepped slots, a plurality of items to be displayed inserted into said slots to thereby provide a terraced display of said items, and support structure integral with at least one of the plurality of panels and connectable to the remaining plurality of panels for holding the display rack in an erected position.

2. A display rack according to claim 1, wherein the plurality of panels comprises a plurality of panels of various widths, score lines provided between adjacent panels, whereby adjacent panels are hingedly connected to each other.

3. A display rack according to claim 1, wherein the support structure comprises a back wall having top, bottom and side edges, the top edge of the back wall being integral with the edge of one of the plurality of panels and being foldable relative thereto, side wall integral with and extending laterally outwardly from the side edges of the back wall and being foldable relative thereto, locking slots formed in the bottom edge portions of said side walls, the opposite edge of each side wall having a plurality of horizontally spaced steps, a locking slot being provided by each space between said steps, certain of said plurality of panels engaging the upper surfaces of said steps, others of said panels being folded and inserted into said locking slots.

4. A display rack according to claim 3, wherein tabs are provided on a leading edge of said steps, and apertures formed in some of said other panels, whereby the tabs are insertable into said apertures to thereby interconnect the panels with the support structure.

5. A display rack according to claim 4, wherein the items to be displayed comprise a plurality of trading cards.

6. A display rack comprising a one-piece die cut blank having a plurality of folded and interconnected panel portions forming a plurality of stepped pockets, the lateral edges of said panel portions being progressively inwardly extending to provide panels of different lengths, whereby a substantially trapezoidal-shaped terraced rack is formed when the blank is folded and interconnected, a plurality of items to be displayed inserted into said pockets, and support structure integral with at least one of the plurality of panels and connectable to the remaining plurality of panels for holding the display rack in an erected position.

7. A display rack according to claim 6, wherein a plurality of the trapezoidal-shaped terraced racks are placed in side-by-side relationship to form an enclosure resembling a stadium.

8. A display rack according to claim 7, wherein the plurality of racks are supported on a base board, means on said board for holding said racks in side-by-side relationship.

9. A display rack according to claim 8, wherein the means for holding the racks in side-by-side relationship on the board comprises a plurality of tabs struck upwardly from the board and engageable with the support structure.

10. A display rack according to claim 8, wherein indicia representing a playing field is placed on the board within the enclosure.

11. A display rack according to claim 6, wherein the items to be displayed comprise a plurality of trading cards.

12. A display rack according to claim 11, wherein the plurality of trading cards are selectively baseball and football cards.

* * * * *

UNITED STATES PATENT AND TRADEMARK OFFICE

CERTIFICATE OF CORRECTION

PATENT NO. : 5,289,926

DATED : March 1, 1994

INVENTOR(S) : Timothy D. Lewis et al.

It is certified that error appears in the above-identified patent and that said Letters Patent is hereby corrected as shown below:

Column 1, line 35, "a" should read -as-.

Column 2, line 26, "10i" should read -10j-.

Column 2, line 30, "10i and" should read -10g and 10j-.

Column 2, line 64, "beck" should read -back-.

Signed and Sealed this

Thirtieth Day of August, 1994

*Attest:*

Bruce Lehman

BRUCE LEHMAN

*Attesting Officer*

*Commissioner of Patents and Trademarks*